US007571509B2

(12) United States Patent
Rosenzweig et al.

(10) Patent No.: US 7,571,509 B2
(45) Date of Patent: Aug. 11, 2009

(54) SURFACE CLEANING APPARATUS

(75) Inventors: Mark Rosenzweig, Chestnut Hill, MA (US); Chad Reese, Auburn, AL (US)

(73) Assignee: Euro-Pro Operating, LLC, West Newton, MA (US)

( * ) Notice: Subject to any disclaimer, the term of this patent is extended or adjusted under 35 U.S.C. 154(b) by 0 days.

(21) Appl. No.: 11/066,299

(22) Filed: Feb. 28, 2005

(65) Prior Publication Data

US 2005/0235440 A1 Oct. 27, 2005

Related U.S. Application Data

(60) Provisional application No. 60/564,296, filed on Apr. 22, 2004.

(51) Int. Cl.
*A47L 11/24* (2006.01)
*A47L 11/33* (2006.01)

(52) U.S. Cl. ..... 15/41.1; 15/23; 15/42; 15/52.1

(58) Field of Classification Search ..... 15/23, 15/41.1, 42, 52.1
See application file for complete search history.

(56) References Cited

U.S. PATENT DOCUMENTS 1,426,765 A * 8/1922 Pesarillo ..... 15/344
1,739,653 A * 12/1929 Sassano ..... 15/52.1
1,991,794 A * 2/1935 Cutright ..... 15/23
2,172,024 A * 9/1939 Haluss ..... 15/23
2,649,597 A * 8/1953 Dullinger ..... 15/23
2,665,439 A * 1/1954 More ..... 15/98
3,368,231 A * 2/1968 Kravos et al. ..... 15/344
3,402,414 A * 9/1968 Bell ..... 15/23
3,482,273 A * 12/1969 Price ..... 15/52.1
3,482,276 A * 12/1969 Fillery ..... 15/349
3,543,320 A * 12/1970 Swetlitz ..... 15/23
3,813,720 A * 6/1974 Sylvie ..... 15/23
3,906,585 A * 9/1975 Mattsson ..... 15/349
4,369,539 A * 1/1983 Nordeen ..... 15/52.1

FOREIGN PATENT DOCUMENTS

CH 586033 * 3/1977

* cited by examiner

*Primary Examiner*—Mark Spisich
(74) *Attorney, Agent, or Firm*—Womble Carlyle

(57) ABSTRACT

A handheld surface cleaning apparatus comprises a body including at least a rear compartment, a forward compartment and a top volume openly connected to the rear compartment. An elongate rotatable brush arrangement is positioned within and extends across the forward compartment. An electric motor assembly is positioned primarily in the rear compartment, with one or more components of the electric motor assembly residing in the top volume.

11 Claims, 4 Drawing Sheets

SURFACE CLEANING APPARATUS

CROSS-REFERENCE TO RELATED APPLICATIONS

This invention claims priority under 35 U.S.C. §119(e) to U.S. provisional patent application 60/564,296, filed on Apr. 22, 2004, the entirety of which is incorporated herein by reference.

FIELD OF THE INVENTION

This invention relates to a handheld surface cleaning apparatus, such as for a floor or upholstery, incorporating an elongate rotatable brush arrangement and an electric motor for rotating the brush.

BACKGROUND OF THE INVENTION

Electric powered sweepers are a useful for cleaning a variety of surface types. However, conventional sweeper designs can be too large for use in small or restricted areas. Additionally, a full size sweeper can be awkward to use on steps or other elevated surfaces.

One solution is to provide a sweeper with a smaller size. While the body of a sweeper can be readily reduced in size, the required components of an electric powered sweeper place a limitation on the amount of size reduction possible using a conventional sweeper design.

What is needed is a sweeper that is convenient for use in cleaning small or restricted areas, or elevated surfaces that are difficult to access with conventional, full-size sweepers.

SUMMARY OF THE INVENTION

In various embodiments, the invention provides a handheld sweeper that can be conveniently used to sweep small or restricted areas, or elevated surfaces that are difficult to access.

In an embodiment, the invention provides a hand-held surface cleaning apparatus, comprising a body having at least a forward compartment, a rear compartment, and a top volume above that is openly connected to said rear compartment. In a preferred embodiment, the top volume is located above an intermediate compartment. The apparatus further comprises an elongate rotatable brush extending across the forward compartment and an electric motor assembly for driving the rotatable brush. In various embodiments, the electric motor assembly comprises at least one component located in the top volume.

In still other embodiments, the invention can further comprise a wall between the forward compartment and the intermediate compartment that is inclined rearwardly, such as at an angle of from 15 to 20 degrees. Additionally, the wall between the intermediate and rear compartments can seal off the rear compartment from the intermediate compartment.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION OF THE INVENTION

Figure 1:
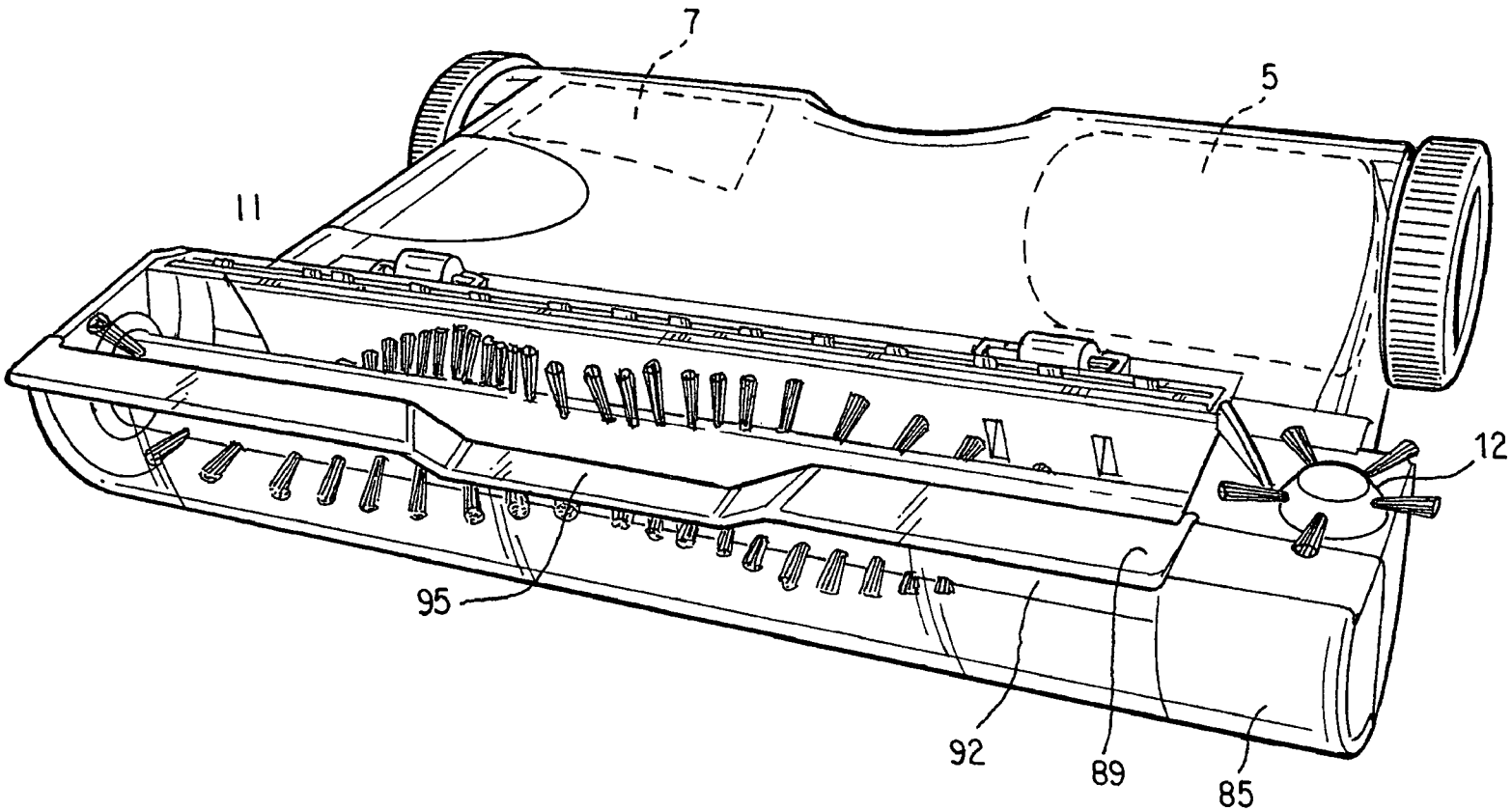
FIG. 1 is a view of a surface cleaning apparatus according to an embodiment of the invention.

In various embodiments the invention provides a handheld surface cleaning apparatus. The surface cleaning apparatus comprises a body suitably moulded of one or more plastic materials and having two or more compartments. At least one of the compartments is used to house a motor and a battery for the surface cleaning apparatus. Additionally, the surface cleaning apparatus comprises at least one top volume openly connected to the at least one compartment containing the motor and battery.

In an embodiment, a rear compartment 3 houses an electric motor 5 and a rechargeable battery pack 7. The battery pack 7 may be connected to a main power supply (not shown) for recharging the battery pack. The battery pack may either be connected to the main supply whenever the apparatus is not in use or at suitable times when the battery pack has become depleted. Switch means 8 is provided to permit a user to energize and de-energize the motor 5 as desired. As an alternative to a rechargeable battery pack, the apparatus could employ disposable batteries or be main powered (i.e., adapted to use standard household alternating current). A handle (not shown) for pushing the sweeper during operation can be attached to the sweeper body in the region of the rear compartment.

A forward compartment 9 houses an elongate rotatable brush arrangement 11. For convenience a forward wall of the forward compartment is arcuate and extends around the periphery of the brush arrangement 11. The bottom of the forward compartment is open at 13 to allow the bristles of the brush arrangement to contact a floor, carpet or the like over which the surface cleaning apparatus is to be moved. The rear of the forward compartment is a rearwardly inclined wall 15 which allows debris, such as dust, dirt and the like, to be propelled up the wall due to rotation of the brush arrangement 11 and to pass over the wall into an intermediate compartment 17 which will be described in more detail hereinafter. The wall 15 extends upwardly to about the same height as the top of the brush arrangement 11 and is angled rearwardly (i.e. away from the forward compartment) at an angle of about 18 degrees. The precise angle is not important, but the inclination facilitates the passage of the debris up and over the wall and at the same time facilitates retention of the debris within the intermediate compartment 17. The brush arrangement extends substantially the entire width of the forward compartment and is provided with two helically arranged rows of bristles. The two rows are diametrically opposed and each row is in the form of a pair of separate helices which twist in opposite directions and meet substantially midway between the ends of the brush arrangement. The width of the rotatable brush arrangement 11 is selected to be between 4 and 8 inches, such as 4.75 inches.

In various embodiments, an intermediate compartment 17 is positioned between the wall 15 and a wall 21 which encloses the electrical components 5, 7 in the rear compartment 3, the wall 21 protecting the components in the rear compartment from the ingress of debris. The intermediate compartment 17 also has a lower wall or bottom, an upper wall or top, and side walls formed by the outer wall of the body 1. Debris therefore accumulates within the intermediate compartment 17. The intermediate compartment is provided with a removable closure to facilitate the removal of debris.

For example, one of the walls, such as a side wall, the upper wall or the lower wall, can be removed in order that the debris can be emptied from the intermediate compartment, the removed wall being replaced once the compartment has been emptied. Ideally, side wall 23 is removable for emptying purposes. The wall 15 provides the advantage that debris does not readily escape from the intermediate compartment 17 and, even if the body is inclined such that the forward compartment is below the intermediate compartment, the debris does not escape from the intermediate compartment. For the purposes of emptying the compartment, the intermediate compartment 17 can itself be removable.

Figure 2:
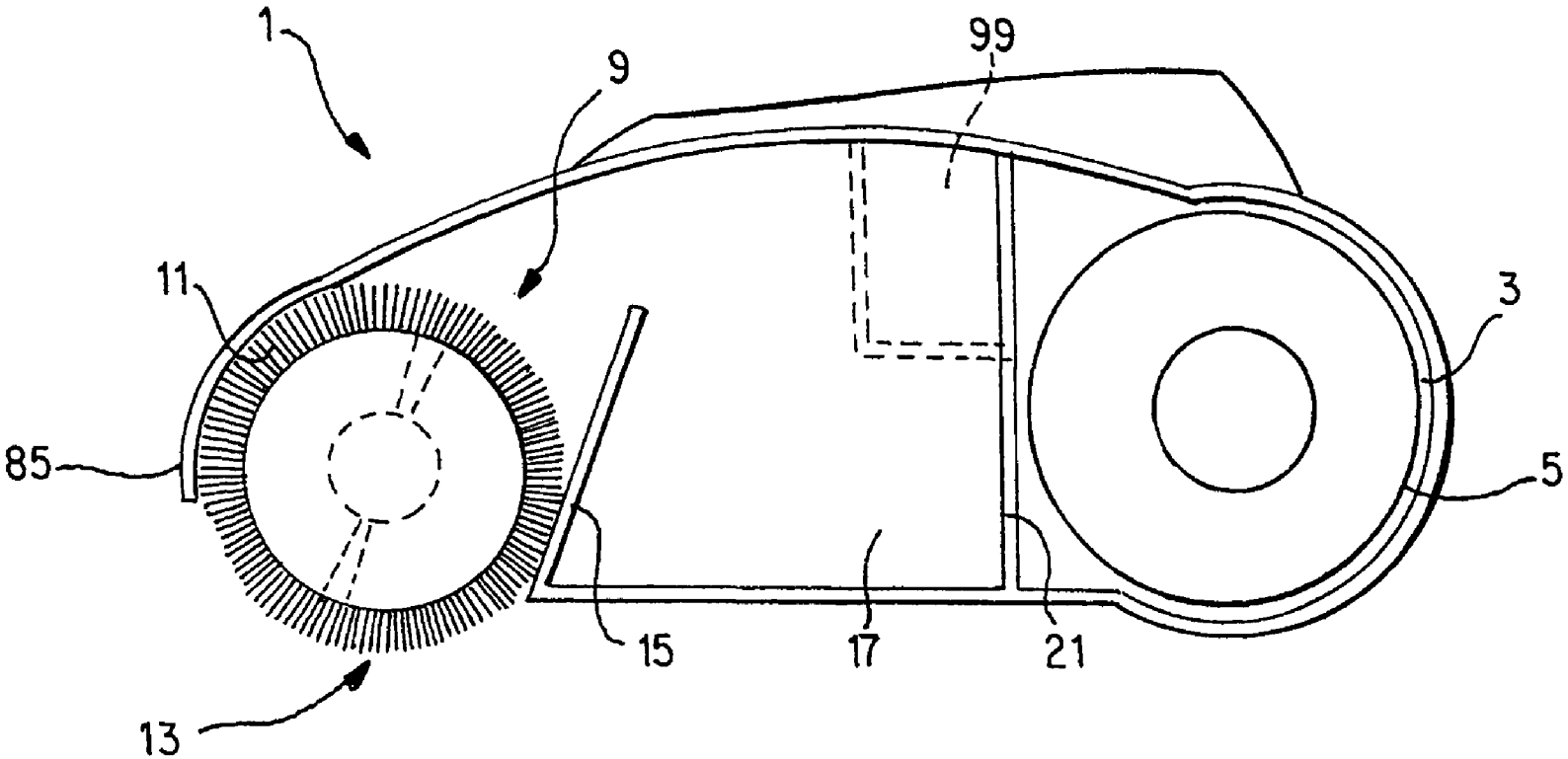
FIG. 2 is a side view of a surface cleaning apparatus according to an embodiment of the invention.

In an embodiment, one or more components of the electric motor assembly can reside outside of the rear compartment. Due to the reduced size, the battery and the motor may occupy most or nearly all of the rear compartment. In this situation, the rear compartment may not have sufficient free volume to house the other parts of the electric motor assembly, such as the switch for activating the motor. To overcome this space limitation, one or more components of the electric motor assembly can be located in a separate top volume which is located above the intermediate compartment. For example, if a push-button switch is used to operate the motor, the switch can be located above the intermediate compartment in a top volume. In such an embodiment, the switch resides in the top volume, which is openly connected to the rear compartment. In embodiments where the rear compartment is sealed off from an intermediate compartment to prevent particles from reaching the motor, the top volume can also be sealed off from the intermediate compartment. FIG. 2 schematically shows a top volume 99 located above an intermediate compartment 17. In the embodiment shown in FIG. 2, top volume 99 is openly connected to rear compartment 3 and sealed off from intermediate compartment 17.

In an embodiment, the brush arrangement 11 is rotated by the motor 5 by way of toothed rollers (not shown) attached to the motor and to the brush, respectively, and by way of a toothed belt (not shown), for example of elastomeric material, extending around the two rollers. The toothed belt can be enclosed within a tunnel where it passes through the intermediate compartment 17 in order to prevent the ingress of debris into the rear compartment 3. The tunnel may pass through the intermediate compartment 17 at any convenient point. However, particularly in the event side wall 23 is removable for emptying purposes, the tunnel may be arranged at that side of the intermediate compartment 17 remote from the side wall 23.

Figure 3:
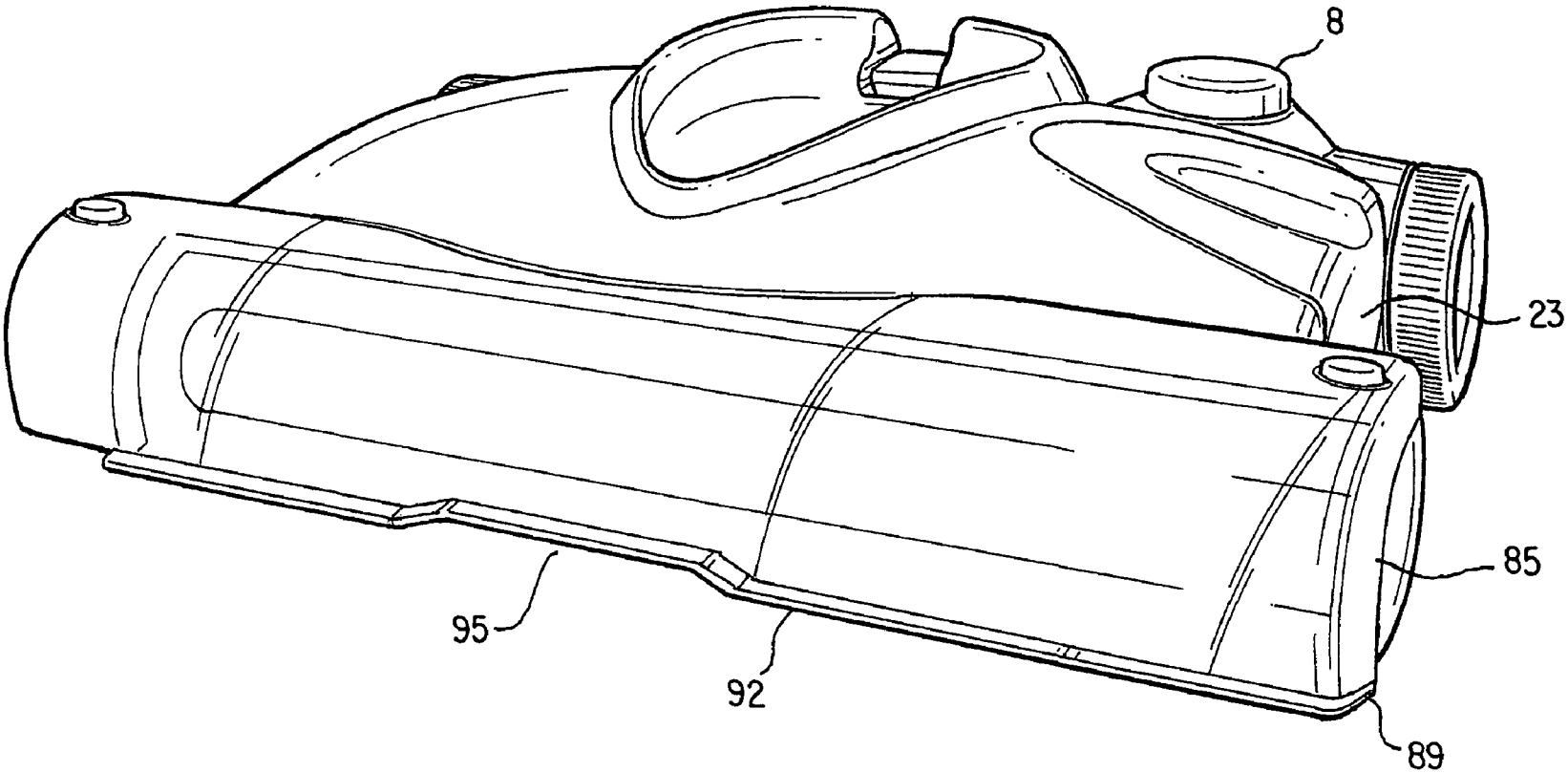
FIG. 3 is a front view of a surface cleaning apparatus according to an embodiment of the invention.

FIGS. 2 and 3 show the profile of a forward compartment according to an embodiment of the invention. Bottom surface 89 of the front wall 85 of the forward compartment is at a higher elevation relative to the surface being swept than the bottom surface of the sweeper body. In an embodiment, the higher elevation of bottom surface 89 is achieved by having the side wall of the forward compartment rise at an angle away from the surface to swept. In an embodiment, this angle is at least 5 degrees and preferably at least 10 degrees. In an embodiment, this angle is 20 degrees or less, preferably 15 degrees or less. Additionally, in an embodiment the bottom surface 89 of the faceplate is also angled away from the surface to be cleaned. The angle of the bottom surface relative to the surface to be cleaned can be any convenient angle, such as the same angle as the rise angle of the sidewall of the forward compartment relative to the surface being swept. In an embodiment, this angle is at least 5 degrees and preferably at least 10 degrees. In an embodiment, this angle is 20 degrees or less, preferably 15 degrees or less.

In embodiments of the surface cleaning apparatus where the bottom surface of the faceplate is elevated relative to the bottom surface of the body, the body can be tipped forward to bring the brush arrangement into closer contact with a surface being cleaned. Because the bottom surface of the front wall or faceplate is elevated, the bottom surface of the faceplate becomes flush with a surface being cleaned when the sweeper body is inclined or tipped forward. This will bring the bristles of brush arrangement into closer contact with the surface being cleaned. For example, on a hard surface the bristles can be arranged to not contact the surface when sweeper body is level. Tipping the body forward allows the bristles to contact the surface during a sweeping operation. For a soft surface such as carpet, the surface cleaning apparatus will have some tendency to sink into the surface, so the bristles may already be contact with the surface to be swept. In this situation, tipping the sweeper body forward allows the bristles to penetrate the carpet more deeply for better cleaning.

Tipping the body forward to bring the brush arrangement into closer contact with a surface is further facilitated by having a lip on the bottom surface of the front wall. In an embodiment, the lip has a greater thickness than the thickness of the rest of the front wall. This reduces the likelihood that the bottom surface will "dig in" when the sweeper is tilted forward toward a surface being cleaned, such as a carpeted surface. Instead, the thicker lip will more evenly distribute weight, which makes it easier to move the surface cleaning apparatus while being tipped forward. FIG. 3 shows an example of this, where bottom surface 89 of front wall 85 has a lip 92 of increased thickness.

In another embodiment, the bottom surface of the front wall is elevated relative to the bottom surface of the sweeper body to create space for admitting particles into the forward compartment during the operation of the sweeper. For example, in an embodiment bottom surface 89 is higher in elevation than the bottom of body 1. Having an elevated bottom surface for the front wall allows particles on a surface to pass under the front wall during sweeping. Particles admitted into the forward compartment by passing under the front wall can then be swept into an intermediate compartment for collection by the brush arrangement.

However, some particles may be larger than the spacing between the bottom surface of the front wall and the surface being swept. Additionally, when the sweeper is used on a soft surface such as carpet, the sweeper may sink into the surface of the carpet, thus reducing the clearance between the bottom surface of the front wall and the surface being swept. Particles that have a height greater than the spacing between the bottom surface of the front wall and the swept surface may be pushed out of the way by the front wall rather than being swept into the intermediate compartment. Still another issue arises when the sweeper is tilted forward to bring the bristles into closer contact with the floor. In this situation, the lip of bottom surface can come into contact with the surface being swept, further reducing the clearance between the bottom surface of the front wall and the surface being swept and thus increasing the risk that particles may be pushed out of the way rather than being collected by the sweeper.

To overcome these potential problems, in an embodiment the front wall or faceplate of the forward compartment can include a notch or opening. The notch or opening increases the distance between the bottom surface of the front wall and the surface being cleaned in the region of the notch. This allows larger particles be admitted through the notch and into the compartments of the sweeper. The notch can be located anywhere on the front wall. Conveniently, the notch or opening can be located in the center of the front wall, as this allows a user of the sweeper to easily align the notch with a particle to be swept.

The height of the opening should be sufficient to allow particles to be swept into the intermediate compartment while the sweeper body is being tipped forward. Preferably the height of the opening relative to the bottom surface of the front wall is the same as the distance from the bottom surface of the front wall to the bottom of the surface cleaning apparatus body. For example, if the bottom surface of the front wall is higher in elevation than the surface to be swept by 1 cm (when the body is not tipped forward), the elevation of the bottom surface in the notch relative to the bottom surface of the rest of the front wall would also be 1 cm. This would lead to a total elevation for the bottom surface of the opening of 2 cm relative to a surface to be swept.

The width of the notch or opening can be of any convenient size, as long as the width is small enough to prevent undue stress on the front wall when the sweeper body is tipped forward to bring the bristles into closer contact with a surface. Thus, the notch or opening can have various widths, as the width of the front wall could range from as small as 2 inches to as large as 20 inches. Other common widths for the front wall include 3 inches, 4 inches, 5 inches, 6 inches, 7 inches, 8 inches, 10 inches, 11.5 inches, 13 inches, 14 inches, and 15 inches. In an embodiment, the width of the opening is at least 10% of the width of the front wall and preferably at least 15%. In an embodiment, the width of the opening is 33% or less of the width of the front wall and preferably 25% or less. In another embodiment, the width of the notch is 1 inch, or 2 inches, or 3 inches, or 4 inches, or 5 inches. FIG. 3 shows an example of a notch or opening 95 in a front wall 85.

As will be apparent particularly from FIG. 2, in an embodiment the bristles of the brush arrangement 11 can extend outwardly from the aperture in the bottom surface of the forward compartment. In order to remove stubborn debris and/or to revitalize carpet the lower front region of the forward compartment may be chamfered, or the front region of the forward compartment may be movable (including removable), to increase the exposure of the bristles in this region. In this way, the forward part of the apparatus may be inclined relative to the surface to be cleaned, thereby increasing contact between the bristles and a surface to be cleaned and, on some surfaces, increasing the depth to which the bristles penetrate and clean the surface.

Although not shown, a front part of the forward compartment 9 may be removed to expose the bristles at the front of the apparatus. This effectively increases the aperture in the forward compartment which would seriously impair the effectiveness of a suction cleaner, but in the present invention can effectively be used to assist in the sweeping of stairs, cleaning upholstery and carpets in vehicles and the like operations where a greater exposed area of bristles can be useful. As an alternative to removing the front part of the compartment 9, the front part may be movable, for example pivotable or slidable, relative to the remainder of the compartment in order to expose the bristles.

Although not shown, the rear compartment 3 may be provided with ground-engaging wheels in order to assist mobility of the surface cleaning apparatus. The ground-engaging wheels may, for example, be formed externally in the side regions of the rear compartment 3 or may be provided within recesses formed at least partly beneath the rear compartment 3.

Figure 4:
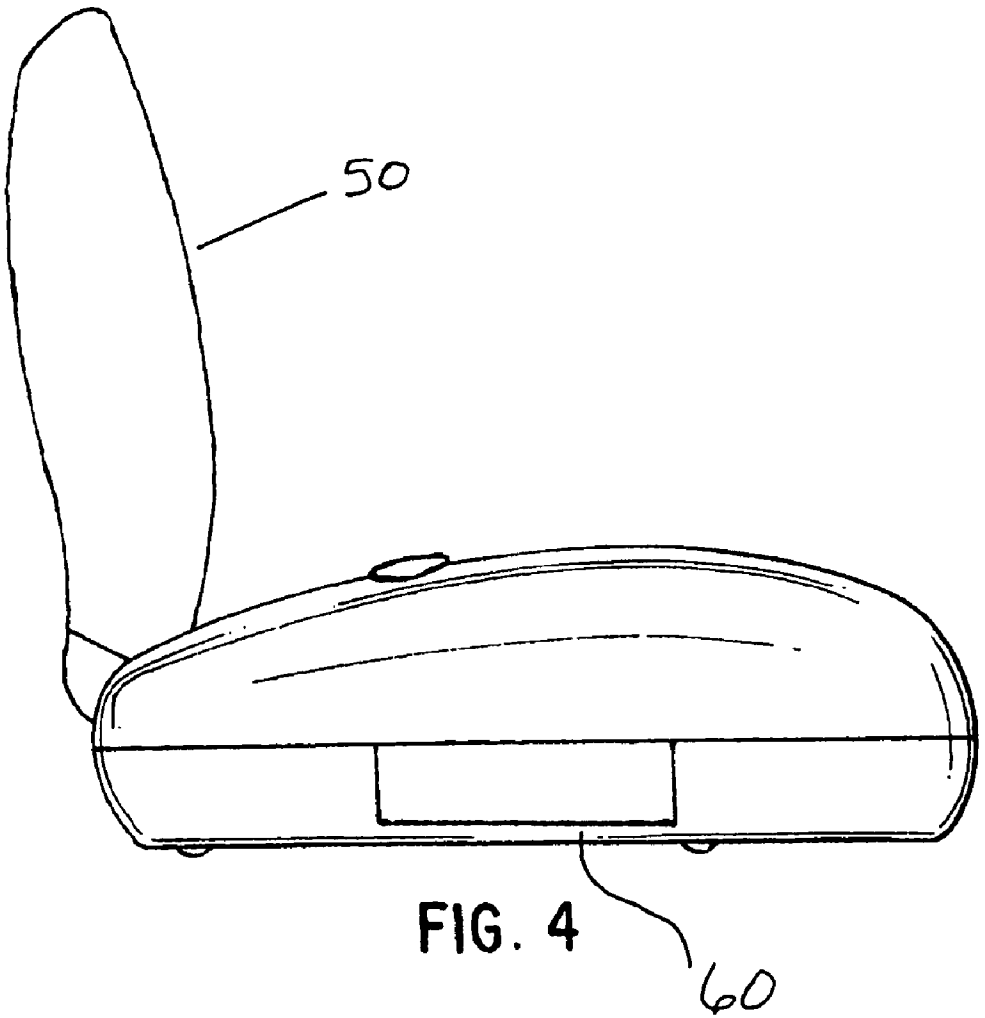
FIG. 4 is a side view of a surface cleaning apparatus according to another embodiment of the invention.

FIG. 4 depicts another embodiment of the invention that includes a handle 50. In FIG. 4, handle 50 is attached to a rear portion of the body of the surface cleaning apparatus, but the handle can also be attached at other locations. Handle 50 can be rotated and/or pivoted relative to the body of the surface cleaning apparatus. The embodiment in FIG. 4 also depicts an intermediate compartment in the form of a removable tray 60.

In an embodiment, handle 50 can be pivoted toward the body of the surface cleaning apparatus to lay the handle flat against the body. This minimizes the volume occupied by the surface cleaning apparatus for storage. In another embodiment, the handle can be pivoted away from the body to form an angle of from 40 to 50 degrees relative to the top surface of the body. This position for the handle provides an ergonomic position for gripping the handle to clean a flat surface. The handle can be locked in this position for ease of use. In still another embodiment, the handle 50 can be pivoted into a flat position away from the top surface of the body. With the handle 50 in a flat position, the surface cleaning apparatus has a low profile that permits cleaning underneath objects with a low clearance.

Although the illustrated embodiments of the invention are intended primarily for domestic use, the surface cleaning apparatus can also be used outdoors or in workshops if desired. However, it may be preferable to provide a more rugged design specifically adapted for such use.

During use of the surface cleaning apparatus according to the invention, as shown in FIGS. 1-4, the apparatus is placed upon a surface to be swept, such as a carpet, and the switch operated to energize the motor and consequently to rotate the brush arrangement to sweep debris from the surface and then propel the debris up and over the inclined wall 15 and into the intermediate compartment 17 where it is temporarily stored. As the surface cleaning apparatus is moved over the surface with the brush arrangement 11 rotating, any further debris is similarly swept from the surface and propelled up and over the wall 15 and into the intermediate compartment 17. The above cleaning action takes place without the need for suction, so the surface cleaning apparatus can be employed as a sweeper. In embodiments involving use as a sweeper, the surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations. In an alternative embodiment, the surface cleaning apparatus can also be incorporated into an upright vacuum cleaner apparatus.

When the surface cleaning apparatus is not in use, it can be stored, for example either in a cupboard or the like or plugged into a main supply in order to recharge the battery 7. In another embodiment, the unit can be stored in a wall mountable charging stand.

In still other embodiments, additional features can be incorporated into the handheld surface cleaning apparatus. For example, in an embodiment the motor can be configured to drive the elongate rotatable brush at multiple speeds. Different brush speeds may be more effective at collecting debris of varying size, so controlling the speed of the rotatable brush allows for improved cleaning efficiency. In another embodiment, the body of the surface cleaning apparatus can include one or more headlights, to allow a user to see debris to be swept. In still another embodiment, the handheld sweeper can include a telescoping handle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A surface cleaning apparatus, comprising:

a) a body having a forward compartment, an intermediate compartment to retain debris, a rear compartment located entirely behind the forward compartment and the intermediate compartment, a wall between the forward compartment and the intermediate compartment, a wall between the intermediate compartment and the rear compartment, and side walls, wherein the wall between the forward and intermediate compartments is inclined rearwardly to facilitate passage of debris up and over the wall and for retention of the debris in the intermediate compartment, and a top volume that is openly connected to said rear compartment;

b) an elongate rotatable brush extending across the forward compartment; and c) an electric motor assembly for driving the rotatable brush, the electric motor assembly comprising:

a motor and a battery pack in said rear compartment, and a switch in said top volume for activating the motor.

2. The apparatus of claim 1, wherein the wall between the forward and intermediate compartments has an angle of inclination of from 15 to 20 degrees.

3. The apparatus of claim 1, wherein the wall between the intermediate and rear compartments seals the rear compartment from the intermediate compartment.

4. The apparatus of claim 1, wherein the top volume is located above the intermediate compartment.

5. The apparatus of claim 4, wherein said top volume is enclosed, said enclosure sealing said top volume from the intermediate compartment.

6. The apparatus of claim 1, wherein the top volume is located forward of the rear compartment.

7. A surface cleaning apparatus, comprising:

a) a body having a forward compartment, an intermediate compartment, a rear compartment located entirely behind the forward compartment and the intermediate compartment, and a top volume above the intermediate compartment that is openly connected to the rear compartment, wherein the intermediate compartment comprises a rearwardly inclined wall between the forward and intermediate compartments to facilitate passage of debris up and over the wall and for retention of the debris in the intermediate compartment;

b) an elongate rotatable brush extending across the forward compartment; and c) an electric motor assembly for driving the rotatable brush, the electric motor assembly comprising:

a motor and a battery pack in said rear compartment, and a switch in said top volume for activating the motor.

8. The surface cleaning apparatus of claim 7, wherein the top volume and rear compartment are sealed off from the intermediate compartment.

9. The apparatus of claim 1, wherein the wall between the forward and intermediate compartments has an angle of inclination of from 15 to 20 degrees.

10. The surface cleaning apparatus of claim 7, wherein the intermediate compartment comprises a removable tray.

11. The apparatus of claim 7, wherein the top volume is located forward of the rear compartment.

* * * * *